US010442576B2

(12) United States Patent
Kreymborg et al.

(10) Patent No.: US 10,442,576 B2
(45) Date of Patent: Oct. 15, 2019

(54) CONTAINER FOR PACKAGING FILLING MATERIALS AND METHOD FOR PROCESSING A WEB MATERIAL

(71) Applicant: Nordfolien GmbH, Steinfeld (DE)

(72) Inventors: Michael Kreymborg, Damme (DE); Klaus Gruterich, Damme (DE); Axel Schwilp, Bad Zwischenahn (DE)

(73) Assignee: Nordfolien GMBH, Steinfeld (DE)

( * ) Notice: Subject to any disclaimer, the term of this patent is extended or adjusted under 35 U.S.C. 154(b) by 731 days.

(21) Appl. No.: 15/018,173

(22) Filed: Feb. 8, 2016

(65) Prior Publication Data

US 2016/0152381 A1 Jun. 2, 2016

Related U.S. Application Data

(62) Division of application No. 13/443,420, filed on Apr. 10, 2012, now abandoned.

(30) Foreign Application Priority Data

Apr. 15, 2011 (DE) ..... 10 2011 017 073

(51) Int. Cl.
*B65D 33/08* (2006.01)
*B65D 33/00* (2006.01)
(Continued)

(52) U.S. Cl.
CPC ..... *B65D 33/08* (2013.01); *B65D 33/002* (2013.01); *B65D 33/02* (2013.01);
(Continued)

(58) Field of Classification Search
CPC ..... B65D 33/08; B65D 33/002; B65D 33/02; B65D 33/2591; B65D 75/008; B65D 75/5866
(Continued)

(56) References Cited

U.S. PATENT DOCUMENTS 2,789,728 A 4/1957 Britton
2,800,269 A * 7/1957 Smith ..... B65D 31/145 102/315
(Continued)

FOREIGN PATENT DOCUMENTS

AU 548255 B2 12/1985
DE 1918528 U 6/1965
(Continued)

*Primary Examiner* — Jes F Pascua
(74) *Attorney, Agent, or Firm* — Muncy, Geissler, Olds & Lowe, P.C.

(57) ABSTRACT

In a container for packaging filling materials, in particular a bag or pouch made of plastic film, comprising at least one container wall surrounding the filling material, which has at least one front and rear wall, and comprising superposed layers formed in the top region of the container, wherein in the top region of the container predetermined layers are connected over at least one section by means of at least one closure means closing the container, below which a section of the top region located adjacent to the region fitted with the opening has a filling material withdrawal region and that at least one section of a connecting seam is disposed so that it runs around an opening at least in some areas in such a manner that in the top region the multilayer region is separated in a sealing manner from the filling space of the container.

8 Claims, 3 Drawing Sheets

Figure 1:
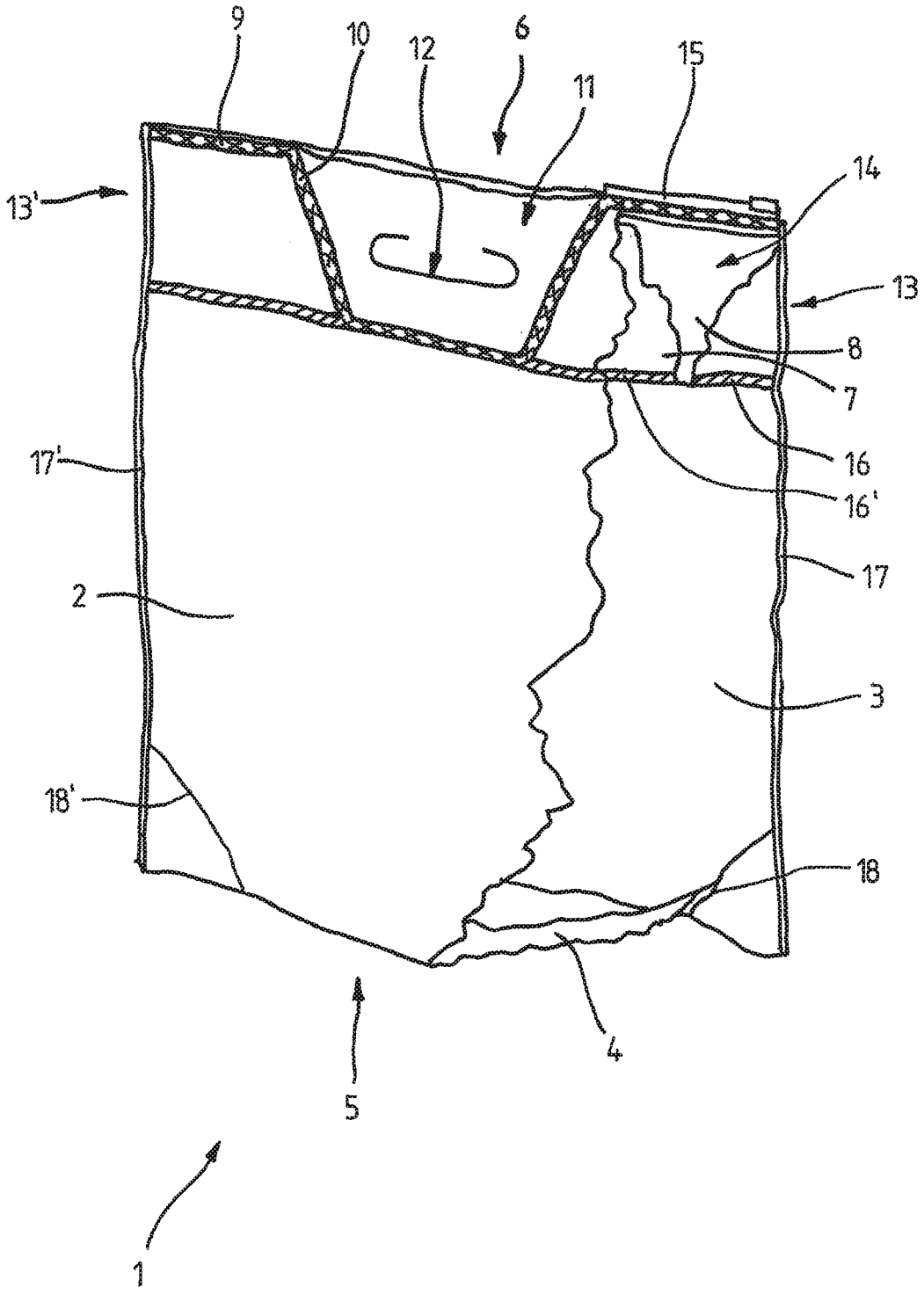

(51) Int. Cl.

| | |
|---|---|
| ***B65D 33/02*** | (2006.01) |
| ***B65D 75/00*** | (2006.01) |
| ***B65D 75/58*** | (2006.01) |
| ***B65D 33/25*** | (2006.01) |
| *B31B 155/00* | (2017.01) |
| *B31B 160/20* | (2017.01) |
| *B31B 70/81* | (2017.01) |
| *B31B 70/86* | (2017.01) |
| *B31B 70/94* | (2017.01) |

(52) U.S. Cl.
CPC ..... *B65D 33/2591* (2013.01); *B65D 75/008* (2013.01); *B65D 75/5866* (2013.01); *B31B 70/8132* (2017.08); *B31B 70/872* (2017.08); *B31B 70/874* (2017.08); *B31B 70/942* (2017.08); *B31B 70/946* (2017.08); *B31B 2155/00* (2017.08); *B31B 2155/0014* (2017.08); *B31B 2160/20* (2017.08)

(58) Field of Classification Search
USPC .. 383/10, 44, 63, 104, 48, 50, 57, 906, 61.2
See application file for complete search history.

(56) References Cited

U.S. PATENT DOCUMENTS

| | | | | |
|---|---|---|---|---|
| 2,951,628 | A | 9/1960 | Grussen | |
| 3,307,549 | A * | 3/1967 | Zackheim | A61M 3/0245 128/DIG. 24 |
| 3,332,420 | A * | 7/1967 | Voller | A61M 3/0245 383/25 |
| 3,337,117 | A * | 8/1967 | Lehmacher | B65D 31/147 383/120 |
| 3,642,189 | A | 2/1972 | Widenback | |
| 4,557,377 | A * | 12/1985 | Maloney | B65B 9/023 206/219 |
| 4,787,755 | A | 11/1988 | Branson | |
| 5,378,065 | A | 1/1995 | Tobolka | |
| 5,593,229 | A | 1/1997 | Warr | |
| 5,941,643 | A | 8/1999 | Linkiewicz | |
| 6,053,635 | A | 4/2000 | Anderson et al. | |
| 6,832,464 | B2 | 12/2004 | Wilson et al. | |
| 8,007,174 | B2 * | 8/2011 | Yamaguchi | A61J 1/10 383/104 |
| 8,430,566 | B2 * | 4/2013 | Brauer | B65D 31/10 383/109 |
| 2003/0236159 | A1 | 12/2003 | Worthy, Jr. | |
| 2006/0210199 | A1 * | 9/2006 | Ali | B65D 33/14 383/10 |
| 2009/0008276 | A1 | 1/2009 | Schneider | |

FOREIGN PATENT DOCUMENTS

| | | |
|---|---|---|
| DE | 2042392 A1 | 5/1971 |
| DE | 8715040 U1 | 1/1988 |
| DE | 20115181 | 1/2002 |
| EP | 1373080 | 1/2004 |
| EP | 1873081 | 1/2008 |
| GB | 1273157 | 5/1972 |
| GB | 1273157 A | 5/1972 |
| GB | 1455570 | 11/1976 |
| WO | WO 2007/143648 A2 | 12/2007 |

* cited by examiner

CONTAINER FOR PACKAGING FILLING MATERIALS AND METHOD FOR PROCESSING A WEB MATERIAL

CROSS REFERENCE TO RELATED APPLICATIONS

This application is a Divisional of co-pending application Ser. No. 13/443,420 filed on Apr. 10, 2012 for which priority is claimed under 35 U.S.C. § 120; and this application claims priority of Application No. 10 2011 017 073.1 filed in Germany on Apr. 15, 2011 under 35 U.S.C. § 119, the entire contents of all of which are hereby incorporated by reference.

BACKGROUND OF THE INVENTION (1) Field of the Invention

The invention relates to a container for packaging filling materials, in particular a bag or pouch made of plastic film, comprising at least one container wall surrounding the filling material, which has at least one front and rear wall, where in the base region of the container between front and rear wall, two inner layers of an interfolding of a web section of the plastic film, which is folded inwards at least on one side on one of its longitudinal sides, are disposed, where a standing base connecting the front and rear wall is formed by means of the interfolding, and comprising a multilayer region comprising more than two superposed layers formed in the top region of the container, where the multilayer region has at least one carrying aid formed as an opening, which opening passes at least partially through the layers in the top region, and comprising seams connecting predetermined layers in the side regions and in the top region. The invention further relates to a method for processing a web material for packaging containers made of plastic film, in particular for film pouches having a multilayer top and base region.

(2) Description of Related Art

Containers for packaging filling materials of the aforementioned genre, which for example are also known as stand-up pouch packages are produced, inter alia, from plastic film which can be welded on both sides or from a composite plastic film which can be welded on one side, and are used in particular for enclosing most diverse types of bulk or filling materials such as, for example, foodstuffs, liquids or similar products.

Such a packaging container according to the preamble of claim 1 is known, for example, from EP 1 373 080 B1, which has a multilayer top region which is completely separated from the filling space of the container by a welded seam. In this case, the welded seam extends over the entire width of the packaging container. However, emptying of the packaging container is relatively difficult since for emptying the container either the top region or the side region must be partially or completely separated. The handling of the container by means of the carrying aid is then severely restricted, however, in order to avoid accidental pouring of the filling material from the container. In the case of a container opened in the side region, it is completely impossible to use the carrying aid formed in the top region in order that uncontrolled escape of the filling material at the side of the container can be eliminated.

BRIEF SUMMARY OF THE INVENTION

It is therefore the object of the invention to provide a container for the packaging of filling materials which enables a simplified and controlled dispensing of the filling material from the container interior. It is further the object of the invention to provide a method for processing a web material which is suitable for producing such a packaging container by which means an improved prefabrication of the web material can be achieved.

The object is solved according to the invention by a container and by a method having features disclosed herein. Advantageous embodiments of the invention are specified in the subclaims related to the respective main claims.

In a container for packaging filling materials, in particular a bag or pouch made of plastic film, comprising at least one container wall surrounding the filling material, which has at least one front and rear wall, where in the base region of the container between front and rear wall, two inner layers of an interfolding of a web section of the plastic film, which is folded inwards at least on one side on one of its longitudinal sides, are disposed, where a standing base connecting the front and rear wall is formed by means of the interfolding, and comprising a multilayer region comprising more than two superposed layers formed in the top region of the container, where the multilayer region has at least one carrying aid formed as an opening, which opening passes at least partially through the layers in the top region, and comprising seams connecting predetermined layers in the side regions and in the top region, it is provided according to the invention that in the top region of the container, predetermined layers are connected over at least one section by means of at least one closure means closing the container, below which a section of the top region located adjacent to the region fitted with the opening has a filling material withdrawal region and that at least one section of a connecting seam is disposed so that it runs around the opening at least in some areas in such a manner that in the top region the multilayer region is separated in a sealing manner from the filling space of the container.

With the aid of a container which has a withdrawal region configured in such a manner according to the invention in its top region, an optimal handling by means of the carrying aid can always be ensured. An unintentional escape of the filling material from the container interior is advantageously avoided by the withdrawal region extending right into the top region. In order to avoid the escape of filling material during transport, predetermined layers in the filling material withdrawal region are interconnected by means of a closure means in such a manner that the container is closed in a sealing manner and the filling material is thereby retained. The filling material withdrawal region is preferably formed in a section of the top region which is directly adjacent to the part of the top region fitted with the carrying aid. The carrying aid and the withdrawal region can be formed at approximately the same height in the top region of the container in the case of a container standing upright on its standing base. In order to furthermore avoid the escape of filling material via the opening serving as a carrying aid in the top region, at least one section of a connecting seam is provided. This connecting seam section separates the multilayer region around the opening in the top region formed in particular from inner and outer layers in a sealing manner from the filling space of the container. Preferably all the layers in the top region are seamlessly interconnected by means of the connecting seam. The connecting seam can be configured as a welded seam placed completely around the opening.

According to an advantageous further development of the invention, it is provided that at least one closure means is disposed along the upper edge regions of the layers to be connected to one another. An advantageous embodiment of the withdrawal region is thereby achieved which is advantageously accessible for the filling material as far as approximately up to the upper marginal edges of the layers in the top region forming the withdrawal region. It is likewise feasible to arrange the closure means at varying heights of the top region of the container.

The closure means can thereby be a reclosure located in the filling material withdrawal region. Using a reclosure such as, for example, a slider or zipper, has the advantage that the container can be reclosed in particular after only a partial withdrawal of the filling material held in the packaging container. Due to the sealing effect of the reclosure, disadvantageous effects on the filling material, for example, due to environmental influences such as, for example, dirt or moisture, can be kept as low as possible. The reclosure in particular comprises two mutually corresponding closure parts which in particular are disposed on mutually facing surfaces of the layers in the filling material withdrawal region. For this purpose, a closure seam which closes the container in the top region in a sealing manner can be used. The reclosure can be arranged to run both parallel to the frequently horizontally running upper marginal edges of the layers forming the multilayer top region and also running at a predetermined angle to the edges of the top region of the container.

Alternatively to a closure means configured as a reclosure, a closure seam which interconnects predetermined layers in the top region can be provided as closure means. A relatively simple and secure closure of the container is achieved by the closure seam, which seals the filling material removing region, in particular running at the upper marginal edges of the layers. A simplified embodiment is advantageous especially for containers for packaging filling materials or packaging containers which are always completely opened after being opened for the first time. For opening the filling material removal region, the container is merely separated or cut in the withdrawal region. The closure seam is preferably a welded seam based on firm bonding by which means an advantageous firm connection can be ensured between the layers to be interconnected.

In particular, a predetermined separating line which weakens surface regions of specific layers is associated with the closure seam which closes the filling material withdrawal region in the top region. With the aid of a predetermined separating line according to the invention, a simplified opening of the packaging container in the filling material withdrawal region and therefore a simplified access to filling material in the filling space of the container is brought about. The use of separate aids for opening the package can advantageously be dispensed with. The predetermined separating line preferably extends over the entire width of the filling material withdrawal region in the top region at a short distance below and in particular parallel to the closure seam closing the withdrawal region.

The multi-layer region comprising more than two layers in the top region between front and rear wall preferably comprises at least one inner layer of an interfolding of the web sections folded inwards along its longitudinal sides. The formation of the top region with at least one inner layer disposed between the front and rear wall of the container, which is formed as an interfolding of a web section folded inwards along its longitudinal sides, constitutes an advantageously simple possibility for multilayer formation of the top region. As a result of the multilayer region comprising more than two layers in the top region, the container acquires an increased strength so that carrying forces can act on this multilayer region without any problems via the carrying aid formed as an opening in the top region. The multilayer region comprising more than two layers can thereby extend in particular over the entire width of the container. In addition to the part of the top region fitted with the opening, the part of the top region configured as the filling material withdrawal region can in particular have at least one inner layer formed as an interfolding between one of the inner sides of the front or rear wall. Preferably parts of the front and rear wall are folded inwards symmetrically in the form of an interfolding so that two inner layers disposed between front and rear wall are formed. In this context, it is feasible to form the different multilayer regions in the top and in the base region of the container asymmetrically so that top and base region have different widths.

According to one further development of the invention, it is provided that each inwardly projecting layer of the interfolding in the top region is fixed by means of at least one connecting seam section on the inner side of a respectively associated front or rear wall. Especially in the case of a filling material withdrawal region configured to be multilayered, it is necessary to fix the inwardly projecting interfolding in order to be able to advantageously ensure undisturbed escape of filling material from the filling space via the withdrawal region. At the same time, in particular the lower ends of the inner layers in the part of the top region adjacent to the withdrawal region can additionally be connected to one another along with the fixing on a corresponding inner side, whereby this part of the top region is then automatically separated from the filling space of the container. Instead of an inward interfolding, it is also possible to produce a multilayer region comprising more than two layers in the top region whereby front and rear wall of the container form the inner layers in the top region and one outer and one inner layer adjacent thereto of the multilayer region.

The multi-layer region comprising more than two layers can be produced in particular by folding over the upper, still-flat-lying ends of the front and rear wall jointly to one side. A four-layer region is thus produced in which the opening can advantageously be introduced as a carrying aid. In this case, front and rear wall can also be connected to one another. If the upper ends of the front and rear wall are not connected, it is also feasible to fold one of the packaging walls inwards and place the adjacent packaging wall with its inner side on the two-layer folded-down outer side of the first packaging wall and thus produce an overlap region with four layers. In order to produce a firm connection between the folded-over layers and avoid escape of filling material via the opening of the carrying aid, the four layers in the top region can be interconnected along the folded-down edges via a connecting seam. The four-layer region is usually separated by a connecting seam section from the filling material withdrawal region which frequently only comprises two layers.

The multilayer region comprising more than two layers is formed in the section of the top region adjoining the filling material withdrawal region. Consequently, preferably only the part of the top region fitted with the opening has a multilayered configuration. The part of the top region having the filling material withdrawal region on the other hand is only formed from two layers, for example, predetermined surface regions, of the front and rear wall. This has the advantage that in the withdrawal region the possibly inward-folded inner layers between front and rear wall no longer need to be fixed on the inner sides of the front and rear wall. For example, the surface pieces which form the inner layers otherwise projecting between the front and rear wall can be separated from the part of the top region forming the filling material withdrawal region.

The connecting seam sealing the opening in the top region from the filling space of the container is preferably formed from a plurality of seam sections running at predetermined angles with respect to one another and can furthermore be part of the closure seam closing the packaging container in the top region. By this means, a separate and optionally complex configuration of closure and connecting seams is advantageously avoided, thereby simplifying the manufacture of such a container according to the invention. The seam sections of the connecting seam and the closure seam can have rectilinear and/or curve-shaped sections. In addition, a separation or division of the top region into in particular a two- and a four-layer region is possible with the aid of the connecting seam separating the opening.

For this purpose, the connecting seam can have one seam section running at the height of and parallel to the inwardly folded-over or outwardly folded-over ends of certain layers, on which, at least on one side, another, adjoining seam section extending at a predetermined angle in the direction of the upper edge region of the layers of the top region is disposed. With the aid of such a configuration according to the invention, a simple possibility is provided to ensure the opening in the top region and the separation of the filling material withdrawal region. In this case, the inwardly folded or outwardly folded layers in the top region are advantageously continuously fixed on the inner or outer sides of front and back wall. In particular, the connecting seam has a section running parallel to the upper packaging end, which is adjoined by other seam sections which extend at an angle of 45 degrees to 90 degrees in the direction of the upper fold edge. This seam section running partly in the packaging longitudinal direction can then go over directly into a closure seam section formed along the upper edges, which closes the container in the withdrawal region. Instead of a connecting seam composed of straight seam sections, it is also feasible to use a connecting seam having seam sections running in a semicircular or curve-shaped manner.

It is further within the framework of the invention that the filling material withdrawal region has an outwardly projecting step formed from predetermined surface regions of at least two layers in the top region. With the aid of the step, it is advantageously possible to pull the filling material withdrawal region outwards whereby the height of the withdrawal region relative to the height of the top region can be enlarged relatively simply. The outward-projecting step of the top region can be formed, for example, by means of parts of not inwardly or outwardly folded-over sections of the front and rear wall. The reclosure disposed in particular in the two-layer and also in the four-layer filling material withdrawal region configured as a step can in turn run parallel to the usually horizontally extending upper marginal edges of the step and also obliquely to the upper marginal edges of the step of the container. The reclosure running obliquely to the side edges and also to the upper marginal edges of the step produces a sloping pouring opening by which means the emptying of the container can advantageously be simplified.

Further provided according to the invention is a method for processing a web material for packaging containers made of plastic film, in particular for film pouches having standing bases, in which at least one flat web is folded to form a folded web having superposed outer and inner layers on both sides along the longitudinal sides, where the subsequent standing base is produced at least on one of the longitudinal sides of the folded web to be produced by folding the folded web longitudinal side inwards and where on the opposite longitudinal side of the folded web forming the subsequent multilayer top region, the longitudinal sides of the flat web forming the ends of a specific layers not connected to one another are superposed, a reclosure is inserted between predetermined surface sections of layers of the folded web not connected to one another at least in certain sections, predetermined surface regions of the superposed layers of the folded web are then connected to the reclosure and to one another in the longitudinal direction of the folded web by means of at least one section of a closure seam and a strand of at least tubular sections each having a multilayer region separated from the interior of the tubular section is produced, in the separated multilayer region of each tubular section of the strand at least a certain number of the superposed layers are cut through to form at least one intervention and the strand is then rolled up to form a coil for further processing.

A re-rollable pouch strand comprising already prefabricated stand-up packages can be produced with the aid of such a processing method according to the invention for a web material made of plastic film used to produce a packaging container. The production of a single package which is always complex to further process can thus be advantageously avoided. In addition, due to the width of the pre-fabricated container formed in the web longitudinal direction, a relatively simple change in the package width is possible whereby the subsequent standing base is formed by means of an in particular inwardly folded longitudinal side and the top region is formed by means of an arbitrarily folded longitudinal side with superposed outer and inner layers of the pouch strand. For this purpose, primarily the distances between the transverse connecting seams and the positioning of the carrying aid and the withdrawal region need to be matched. Furthermore, as a result of placing the base region to be produced and the top region to be produced in the lateral regions of the web material, an advantageously simple filling in the longitudinal direction of the pouch strand, that is from the actual side of a packaging container separated briefly before or after the filling and closing, is advantageously possible. In the claimed method a flat material web comprising a continuously weldable plastic film or comprising a unilaterally weldable plastic composite film can be used. The longitudinal edges thereof are placed one upon the other in a multilayer region along one of the longitudinal sides of the folded web produced in such a manner that, for example, the marginal edges of the flat web form the ends of outer or inner superposed layers on the longitudinal side of the folded web which serves as the subsequent top region. The standing base, on the other hand, is formed by means of an interfolding of a continuous surface piece so that the two inner layers of the interfolding are always directly connected to outer layers of the folded web forming the front and rear wall of a packaging container to be assembled. After folding to form a folded web, a reclosure is inserted or slid into the part of the top region forming the withdrawal region over a predetermined section, in particular between mutually facing surface sections of layers not connected to one another, by which means the withdrawal region is advantageously closed at the upper marginal edges. The interconnection of the upper marginal regions of the superposed non-connected layers whereby at least parts of the folded web are configured to form a strand with tubular web sections or a completely closed tube and the reclosure is connected to certain layers, is accomplished with the aid of at least one section of a closure seam. At the same time, at least one multilayer region in the top region is separated from the interior of the tubular web section with the aid of the closure seam. An intervention serving as a carrying aid can now be produced in the separated multilayer region by cutting through at least two of the in particular four layers in the top region.

Alternatively it is possible to use a tube or a tubular web instead of a flat web in a method to be protected separately. According to an alternatively configured method for processing a web material at least one tubular web is folded to form a flat tube having superposed outer and inner layers on both sides along the longitudinal sides, where the subsequent standing base is produced at least on one of the longitudinal sides of the flat tube to be produced by folding the tubular web longitudinal side inwards and along the opposite longitudinal side of the flat tube forming the subsequent multilayer top region comprising more than two superposed layers, predetermined layers on at least one folding edge interconnecting the layers are at least partially separated and a material web having folded web sections is produced. All other processing steps following the production of the material web with folded web sections are identical to the processing method already described previously.

By means of this method according to the invention, a strand having prefabricated tubular web sections can advantageously be produced from a tube, produced for example, by means of blow extrusion. The pouch strand can be rolled up relatively easily to form a roll, whereby a strand manufactured in such a manner according to the invention is optimally suitable for reprocessing, in particular filling with filling material and producing and closing individual pouch sections, possibly carried out previously and/or following on from this, in a filling plant. In particular, by separating the web material present as flat tube, preferably in the area of a folded edge, a material web with tubular and folded web sections or a folded web opened completely in the longitudinal direction in one region can be produced. The separation of at least one folded edge can be accomplished in particular before folding the longitudinal side of the material web forming the subsequent top region or only after the corresponding longitudinal side has been folded to form a region having more than two layers on the flat tube. The reclosures are inserted at predetermined distances from one another between the optionally only partially cut folded web sections of the material web. As described previously, this is followed by further working processes forming the strand.

It is further provided that surface regions of the folded web or the flat tube are folded inwards to form the top region comprising more than two layers. The production of interfoldings each comprising two layers along both longitudinal sides of the flat web or the flat tube so that the outer layers extend over the entire width of the respective material web constitutes an advantageous possibility for forming the longitudinal sides forming the subsequent top or bottom region. Interfoldings having a different interfolding depth can thereby be produced so that the multilayer longitudinal sides of the material web have different widths.

It is alternatively provided that superposed surface regions of the folded web or the flat tube are folded over together on one side on the outside so that they are superposed to form the top region comprising more than two layers. The layers extending continuously from one longitudinal side to the other longitudinal side consequently then form an outer and an inner layer and the folded-over surface regions also form an inner and an outer layer on the longitudinal side serving as the top region of the container. It is also feasible that the marginal regions of a folded web are folded over outwards on both sides so that the folded-over surface regions each form the outer layers on the corresponding longitudinal side of the material web.

Regardless of the type of folding implemented on the longitudinal side of the material web forming the top region, it can thereby be provided that a folding-in or folding over of surface regions of the longitudinal side is accomplished in sections in the longitudinal direction of the material web. Thus, outwardly protruding steps are formed at predetermined distances from one another on one of the longitudinal sides. The region of the step which in particular forms the subsequent withdrawal region of a package can in this case comprise only two layers in contrast to the in particular four-layer region of the folded longitudinal side.

In connection with a flat web used in the method according to the invention, which is folded to form a folded web where certain superposed surface regions are folded over together on one side on the outside on the longitudinal side forming the subsequent top region, it is provided in particular that at least one folded edge connecting layers to one another is cut, at least in sections, along the longitudinal side of the folded web forming the top region. The cutting is necessary in order to open at least one section of the folded web so that the reclosure which delimits the filling material withdrawal region of a container to be produced at the top can advantageously be inserted between the layers provided for this.

Optionally it is possible to form respectively one of the side seams of a packaging container to be produced by means of transverse connecting seams running transversely to the longitudinal direction of the strand at predetermined intervals on a strand comprising at least tubular web sections, with the result that a pouch strand having pouch-shaped tubular sections is produced. The pouch strand can thus be produced before rolling up the strand to form a coil where the side seam delimiting the subsequent packaging container forms a filling base used for the filling process. When viewed in the longitudinal direction, the pouch strand is thus closed in a sealing manner at fixed or predetermined distances from one another. It is naturally also feasible to produce the transverse connecting seams in the filling plant where a first lower transverse connecting seam is produced shortly before the filling process. The other upper transverse connecting seam usually located in the filling direction of the container to be filled from the side is produced after filling and the container is therefore closed in a sealing manner. The transverse connecting seams are in particular produced by means of welded seams based on firm connection.

It is furthermore within the framework of the invention that the pouch strand is weakened directly adjacent to and along a respective transverse connecting seam. A finished packaging container can thus be formed after the filling and subsequent closure of a pouch section still connected to the pouch strand by tearing the pouch section from the pouch strand. A separating cut to be executed transversely to the longitudinal direction of the web material can thus advantageously be dispensed with. The weakening of the pouch strand is made directly adjacent to a transverse welded seam and can, for example, be carried out with the aid of the perforation process where the perforation line to be produced then runs approximately at right angles to the longitudinal sides of the pouch strand.

According to a further development of the invention it is provided that at least one corner weld running obliquely to a multilayer longitudinal side of the pouch strand is produced before or after producing the transverse connecting seam. The corner weld is accomplished in particular on the still flat-lying folded web so that the corner welds can be implemented simultaneously between the superposed inner sides of the four layers in the base region with the aid of appropriate sealing tools. When using a plastic film configured to be weldable on both sides, a plate element is preferably inserted between the outer sides of the inner layers so that the firm interconnection of the outer sides of the interfolding running in the base region is prevented.

The multilayer region separated from the interior of a respective tubular web section is preferably stamped with an opening for equipment. The stamping process provides an advantageously simple possibility for forming a carrying aid configured as an opening in the multilayer region of the pouch strand separated accordingly from the container interior. By means of the stamping, sections of the layers can be completely removed or only partially cut through so that corresponding regions of the superposed layers can be folded over and an opening for gripping through is exposed.

BRIEF DESCRIPTION OF THE SEVERAL VIEW OF THE DRAWINGS

Figure 2:
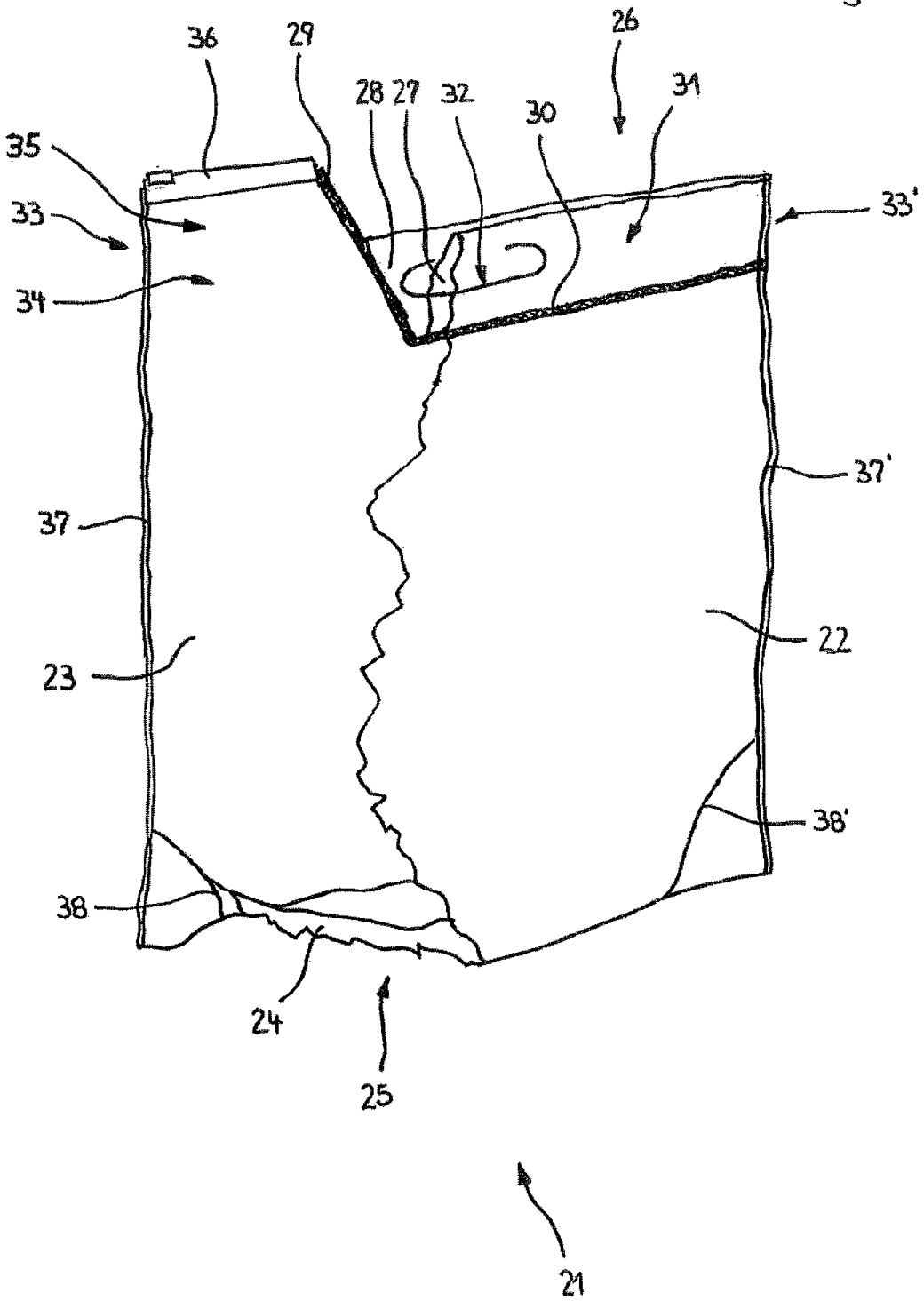
Figure 3:
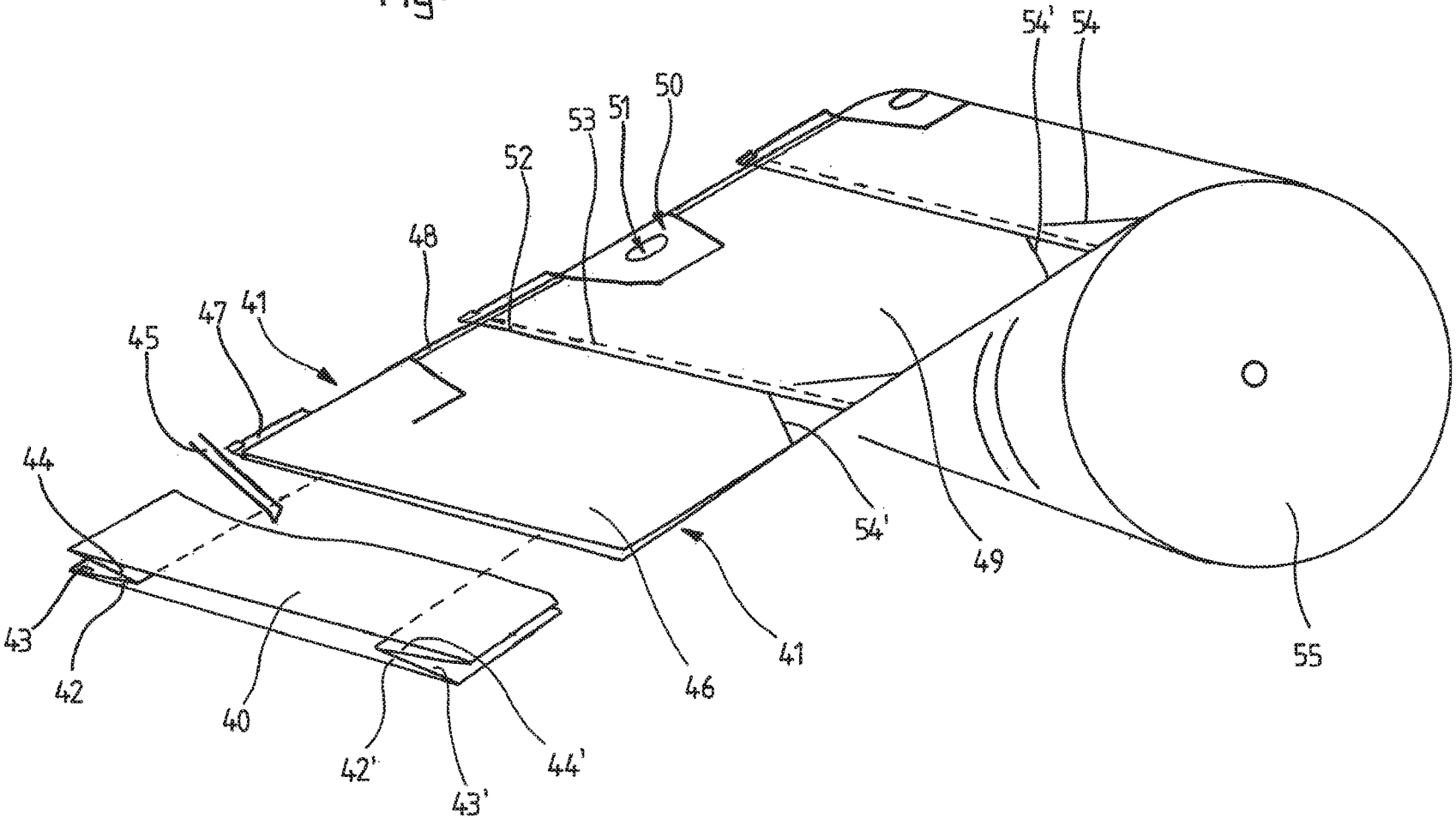

Possible exemplary embodiments of the invention, from which further inventive features are obtained are shown in the drawings. In the figures:

FIG. 1: shows a perspective view of a first container for packaging according to the invention;

FIG. 2: shows a perspective view of a second packaging container according to the invention and FIG. 3: shows a schematic view of a processing method for a web material for producing packaging containers from plastic film.

DETAILED DESCRIPTION OF THE INVENTION

A container for packaging bulk materials is designated by 1, said container having a front wall 2, a rear wall 3 and a standing base 4. The standing base 4 is thereby produced from two inner layers of an interfolding of a tubular web or flat web folded-in on the longitudinal sides in the longitudinal direction so that the base region 5 of the packaging container is accordingly four-layered in the flat state. The container 1 further has a likewise multilayer top region 6 which is also produced by an interfolding on the other longitudinal side of the tubular or flat web used to form the packaging container. In this embodiment, the inner layers 7, 8 of the top region 6 are only interconnected in sections, where the inner layers in the sections not connected to one another are separated from one another in the area of the folded edge. It is also feasible to separate a folded edge interconnecting an inner and outer layer, for example, at least in a piecewise manner. A closure seam 9 is additionally provided in the top region 6, by which means the packaging container is closed in the top region. Part of the closure seam is a connecting seam 10 which separates a multilayer region 11 of the top region from the container interior in such a manner that the multilayer region 11 can be equipped with a carrying aid configured as an opening 12. The connecting seam 10 prevents any escape of filling material via the opening in the different layers of the top region 6. The sections of the closure seam 9 running in the lateral regions 13, 13' on the upper edge regions of the inner layers 7, 8 create a section of the top region which is accessible for filling material between the inner layers. In particular a filling material withdrawal region 14 is formed in the lateral region 13 of the top region 6, which ensures an advantageously simple withdrawal of the filling material accommodated in the filling space of the packaging container 1. The filling material withdrawal region 14 further has a closure means configured as a reclosure 15 for withdrawal of the filling material in portions, over a predetermined section, in particular on the upper edge region of the container between the inner layers 7, 8. The closure parts thereof are likewise connected in a firmly bonded manner via the closure seam 9 to the surface pieces of the inner layers facing the reclosure. In order that the lower ends of the inner layers 7, 8 do not hinder the emptying of the container 1, these are each fixed on the inner sides of the associated front and rear wall with the aid of connecting seam sections 16, 16'. No connection of the lower ends to one another is provided in this case. Lateral seams 17, 17' configured as welds are provided for lateral closure of the packaging container 1 usually filled from the side. For increased stability of the standing base 4 the packaging container 1 additionally has corner welds 18, 18' in its base region 5, which interconnect predetermined surface pieces of the standing base 4 to the inner sides of the front and rear wall 2, 3 in the base region 5.

FIG. 2 shows another exemplary embodiment of a container 21 according to the invention, which also has a front wall 22 and a rear wall 23. The front and rear wall are in turn interconnected via a standing base 24 in the base region 25. In the top region 26 two inwardly folded inner layers 27, 28 are disposed at the upper ends of the front and rear wall 23, 24. In this embodiment the inner layers 27, 28 are only formed above a predetermined section in the top region between front and rear wall. The lower ends of the inner layers protruding between front and rear wall are interconnected by means of a closure seam 29 which closes the container 21 in a sealing manner where at the same time, the multilayer region 31 of the top region 26 with the carrying aid configured as opening 32 is separated from the filling space of the packaging container 21 by means of the closure seam 29 which comprises a connecting seam 30. Furthermore, in this exemplary embodiment only one of the lateral regions 33, 33' is accessible for filling material, where the lateral region 33 of the top region 26 also has a filling material withdrawal region 34 for simplified withdrawal of the filling material. In this case, the filling material withdrawal region 34 is only two-layered, where the top region 26 comprises an outwardly projecting step 35 forming parts of the filling material withdrawal region. The step 35 can be formed, for example, in the top region with the aid of sections of non-inwardly folded surface pieces of the front and rear wall. In turn a reclosure 36 sealing the withdrawal region is provided on the upper marginal edge of the filling material withdrawal region 14. The sides of the container 21 are closed by means of side seams 37, 37' and furthermore, the container additionally has corner welds 38, 38' in its base region 25.

FIG. 3 shows a processing method for a web material used to produce packaging containers from plastic film, which in the present case was produced from a tubular web. Alternatively, a flat web can be used instead of a tubular web which then merely needs to be laid together to form the required folded web. The tubular web is folded to form a flat tube 40 with interfoldings 42, 42' inserted inwards along both longitudinal sides 41, 41'. The interfoldings 42, 42' form the inner layers 43, 43', 44, 44' in the top and base region of a packaging container to be produced. Initially, on the interfolding 42 forming the subsequent top region of the packaging container, a folded edge connecting the inner layers 43, 44 is separated by means of a separating device 45 so that a folded web 46 open at one point is formed from the flat tube 40. A reclosure 47 is inserted between the non-interconnected inner layers 43, 44 and fastened to the mutually facing surfaces of the inner layers in the upper edge regions by means of a closure seam 48 which at the same time interconnects predetermined sections in the top region of the folded web to form a strand 49 of at least closed tubular sections. Located below the reclosure 47 is the filling material withdrawal region then provided in the subsequent top region of the packaging container to be produced. The closure seam 48 has seam sections configured to be offset parallel to one another which are connected with the aid of sloping seam sections running at predetermined angles to the parallel seam sections. A multilayer region 50 is separated by means of the closure seam 48 from the interior of the tubular section in which an opening 51 penetrating through at least certain layers of the multilayer region 50 is then stamped. In addition, transverse connecting seams 52 are produced transversely to the longitudinal direction of the strand 49 at predetermined distances from one another, where however when preassembling the pouch strand, in each case only one of the lateral seams laterally delimiting the subsequent packaging container is formed. The second lateral seam is only produced after lateral filling of the pouch-shaped tubular section. Parallel to the transverse connecting seams 52 produced, the pouch strand is continuously weakened in a near region to a respective transverse connecting seam and a perforation line 53 is produced. A tubular section filled and closed in a filling plant can then be torn directly from the pouch strand via the perforation line, whereby a lateral opening of the following pouch-shaped tubular section is produced at the same time. In addition, two corner welds 54, 54' are formed in the region of the interfolding forming the subsequent base region on both sides of a transverse connecting seam 52 possibly already produced, which run at a predetermined angle to the longitudinal sides 41, 41' of the strand and the transverse connecting seams 52 produced. The corner welds 54, 54' produced at the same time are thereby formed on directly adjacent tubular web sections. The corresponding preassembled pouch strand is finally rolled up to form a coil 55 destined for further processing in a filling plant. In addition to the filling of the pouch sections of the pouch strand, at least every other lateral seam on the packaging container is made inside the filling plant.

The invention claimed is:

1. Container for packaging filling materials, in particular a bag or pouch made of plastic film, the plastic film having longitudinal sides, the container having a top region, a base region and a side region and comprising at least one container wall surrounding the filling material, which has at least one front and rear wall, the front and rear wall each having an inner side, wherein in the base region of the container between front and rear wall, two inner layers of an interfolding of a web section of the plastic film, which is folded inwards at least on one side on one of its longitudinal sides, are disposed, wherein a standing base connecting the front and rear wall is formed by the interfolding, and comprising a multilayer region comprising more than two superposed layers formed in the top region of the container, wherein the multilayer region has at least one carrying aid formed as an opening, which opening passes at least partially through the layers in the top region, and comprising seams connecting predetermined layers in the side regions and in the top region, wherein in the top region predetermined layers are connected over at least one section by at least one closure means closing the container, below which in the top region a section of the top region located adjacent to the region fitted with the opening has a filling material withdrawal region, wherein the multi-layer region comprising more than two layers is formed in the section of the top region adjoining the filling material withdrawal region, wherein all the layers in the top region are seamlessly interconnected by a connecting seam formed from a plurality of seam sections running at predetermined angles with respect to one another, and wherein at least one section of the connecting seam is disposed so that it runs around the opening at least in some areas in such a manner that in the top region the multilayer region is separated in a sealing manner from the filling space of the container, wherein the multi-layer region comprising more than two layers in the top region between front and rear wall comprises inner layers of an interfolding of the web sections folded inwards along its longitudinal sides, wherein each inwardly projecting layer of the interfolding in the top region has a lowermost end and is fixed by at least one connecting seam section on the inner side of the front or rear wall in order to be able to ensure undisturbed escape of filling material from the filling space via the withdrawal region, and wherein the lowermost ends of the inner layers are exclusively in the part of the top region adjacent to the withdrawal region additionally connected to one another along with the fixing on a corresponding inner side, whereas each inwardly projecting layer of the interfolding in the withdrawal region of the top region is fixed by means of at least one connecting seam section exclusively on the inner side of the front or rear wall.

2. The container according to claim 1, wherein at least one closure means is disposed along the upper edge regions of the layers to be connected to one another.

3. The container according to claim 1, wherein the closure means is a reclosure for the filling material withdrawal region.

4. The container according to claim 2, wherein the closure means is a closure seam which interconnects predetermined layers in the top region.

5. The container according to claim 4, wherein a predetermined separating line which weakens surface regions of specific layers is associated with the closure seam which closes the filling material withdrawal region in the top region.

6. The container according to claim 4, wherein the connecting seam sealing the opening in the top region is part of the closure seam interconnecting the predetermined layers in the top region.

7. The container according to claim 6, wherein the closure seam has at least one seam section miming at the height of and parallel to the inwardly folded-over or outwardly folded-over ends of certain layers, on which, at least on one side, another, adjoining seam section extending at a predetermined angle in the direction of the upper edge region of the layers of the top region is disposed.

8. The container according to claim 7, wherein the filling material withdrawal region has an outwardly projecting step formed from predetermined surface regions of at least two layers in the top region.

* * * * *